US007626507B2

(12) United States Patent
LaCasse

(10) Patent No.: US 7,626,507 B2
(45) Date of Patent: Dec. 1, 2009

(54) INTELLIGENT DIRECTIONAL FIRE ALARM SYSTEM

(76) Inventor: Steve B. LaCasse, 143 SW. South Danville Cir., Port St. Lucie, FL (US) 34953

( * ) Notice: Subject to any disclaimer, the term of this patent is extended or adjusted under 35 U.S.C. 154(b) by 344 days.

(21) Appl. No.: 11/503,491

(22) Filed: Aug. 11, 2006

(65) Prior Publication Data

US 2007/0152808 A1 Jul. 5, 2007

Related U.S. Application Data

(63) Continuation of application No. PCT/US2005/004536, filed on Feb. 14, 2005.

(60) Provisional application No. 60/544,374, filed on Feb. 13, 2004.

(51) Int. Cl.
*G08B 17/12* (2006.01)

(52) U.S. Cl. ..... 340/577

(58) Field of Classification Search ..... 340/524, 340/506, 632, 628, 577, 539.1
See application file for complete search history.

(56) References Cited

U.S. PATENT DOCUMENTS

| | | | | |
|---|---|---|---|---|
| 4,525,700 | A | 6/1985 | Kimura et al. | |
| 4,544,921 | A | 10/1985 | Fujisawa | |
| 4,556,873 | A | 12/1985 | Yamada et al. | |
| 4,697,172 | A | 9/1987 | Kimura | |
| 4,801,928 | A * | 1/1989 | Minter | 340/691.2 |
| 4,816,808 | A | 3/1989 | Morita | |
| 5,140,301 | A | 8/1992 | Watanabe | |
| 5,257,007 | A | 10/1993 | Steil et al. | |
| 5,559,492 | A | 9/1996 | Stewart et al. | |
| 5,572,183 | A * | 11/1996 | Sweeney | 340/332 |
| 5,627,515 | A | 5/1997 | Anderson | |
| 5,886,620 | A | 3/1999 | Stewart et al. | |
| 6,029,558 | A | 2/2000 | Stevens et al. | |
| 6,081,192 | A | 6/2000 | Takahashi et al. | |
| 6,141,595 | A | 10/2000 | Gloudeman et al. | |
| 6,181,251 | B1 | 1/2001 | Kelly | |
| 6,239,697 | B1 | 5/2001 | Murao | |
| 6,281,791 | B1 | 8/2001 | Murao | |
| 6,490,530 | B1 | 12/2002 | Wyatt | |
| 6,701,281 | B2 | 3/2004 | Satoh et al. | |
| 7,005,994 | B2 * | 2/2006 | King | 340/628 |
| 2002/0163428 | A1 * | 11/2002 | Weng | 340/506 |
| 2003/0201784 | A1 | 10/2003 | Potter | |
| 2004/0036587 | A1 | 2/2004 | Jefferson | |
| 2004/0038385 | A1 | 2/2004 | Langlois et al. | |
| 2005/0110632 | A1 * | 5/2005 | Berezowski et al. | 340/521 |

* cited by examiner

*Primary Examiner*—Phung Nguyen
(74) *Attorney, Agent, or Firm*—Bourque and Associates, PA

(57) ABSTRACT

An intelligent directional fire alarm system is disclosed. The intelligent directional fire alarm system identifies a threat such as a fire, and the location within a building relative to the known exits for building occupants, and indicates the closest exits in each area of a building relative to the location of an identified threat, and the path towards the exit for evacuees throughout a given building, relative to the detected fire location(s).

11 Claims, 4 Drawing Sheets

FROM ADDITIONAL FLOORS
116
BACKUP REPORTING MODULE
120
INPUT (WARNING SIGNALS)
118
BACKUP REPORTING MODULE
COMMUNICATION DOWNLOAD MODULE
160
INPUT
OUTPUT
CONTROL BOX (CENTRAL)
MICRO-PROCESSOR
140
150
180
PROGRAM MEMORY
BATTERY BACK UP
200
130
OUTPUT (RESULTING DECEPTION SIGNALS TO LIGHTS)
114
SECOND FLOOR
112
FIRST FLOOR
196
EXIT
115
EXIT
191
EXIT
116
EXIT
35
36
37
38
31
32
33
34
192
192a
193
193a
194
194a
195
195a
111
111a
112
112a
113
113a
114
1

INTELLIGENT DIRECTIONAL FIRE ALARM SYSTEM

RELATED APPLICATIONS

The present application is a Continuation of co-pending PCT Application No. PCT/US05/04536, filed on Feb. 14, 2005, which in turn, claims priority from U.S. Provisional Application Ser. No. 60/544,374, filed on Feb. 13, 2004. Applicants claim the benefits of 35 U.S.C. §120 as to the PCT application and priority under 35 U.S.C. §119 as to said U.S. Provisional application, and the entire disclosures of both applications are incorporated herein by reference in their entireties.

BACKGROUND OF THE INVENTION

1. Field of the Invention

The present invention relates to emergency alarm systems for buildings. More particularly, the present invention relates to a directional fire alarm system for indicating the exit and the path towards the exit for evacuees throughout a given building, relative to the detected fire location(s).

2. Description of the Related Art

It is known in fire fighting circles that when a fire breaks out, time is of the essence, and that building occupants must proceed to the nearest exit in an orderly, yet timely fashion. Typical fire alarm systems in buildings, such as those described in U.S. Pat. Nos. 4,556,873, 5,627,515, 4,697,172, and 6,281,791, all of which are hereby incorporated by reference, generally detail fire alarm systems with threat sensors that detect the presence of a fire and perhaps its general location according to a zone, the data of which are relayed to a central box, typically situated in a lobby for reading by authorized personnel. However, these systems are generally "dumb" systems that do nothing more than sound a siren or alarm to alert building occupants of a fire, (who must follow unmarked paths to an illuminated "EXIT" sign posted above an exit) and do not provide occupants and/or rescuers with useful escape information based on the relative spatial threat of a fire.

As such, many deaths and injuries occur because of poorly marked exit paths, or because the locally mandated exit signs are obscured by smoke and/or darkness that typically occur during an emergency such as a fire, earthquake, explosion, gas release, black-out, and the like. Moreover, the presently known alarm systems are both expensive and difficult to produce, install and maintain, and often do not address a variety of emergency situations other than fires. Additionally, prior art systems merely provide an audible alarm sound, or in more "advanced" systems, fixed strobe lights or stationary "exit" lamps fixed at exit. Furthermore, exit lamps that are used in conjunction with conventional fire alarm systems consume excessive power from battery operated emergency power supply systems and therefore fail to effectively produce sufficient light after an initial period of operation. In addition, conventional exit lamps are unreliable because they can unpredictably burn out at the time of emergency use. In addition, the indication lamps and arrangements in conventional systems are difficult to see and understand during emergency situations. Conventional systems also fail to provide information about alternative routes of egress.

Nevertheless, there have been attempts in the prior art to overcome some of these problems in directing evacuees to exits, but none provide a means to direct evacuees from all areas and floors of a building away from the direction of a fire reported by a fire alarm system. For example, U.S. Pat. No. 5,140,301 by Watanabe, and U.S. Pat. No. 6,181,251, by Kelly, disclose various laser directional means for pointing down the length of a hall way or room, towards a an exit. These types of systems, however, do not offer panicked evacuees a clear sense of direction, given that a laser may point from say, point A to Point B, but cannot show whether one should proceed towards point A, rather than point B, or vice-versa. Even where such systems attempt to point to a direction by decreasing the slope from say, high to low along the length of a space, for long lengths of corridors, this method does not work as well as in smaller confines. In any case, however, this approach is fraught with shortcomings in that it is not an immediately obvious, fool-proof means of directing evacuees toward an exit, especially if such evacuees have not been already instructed in the interpretation of such laser points.

In addition, U.S. Pat. No. 5,572,183, Sweeney, discloses a laser light evacuation system that directs multiple vertical columns of lights from the ceiling to the floor of a corridor, in which the lights are sequenced from left-to-right and right-to-left during a fire to direct people to the nearest safe exit. However, this approach too, is not immediately intuitive to panicked evacuees who may not understand the meaning of sequenced columns of vertical lights throughout corridors.

Finally, U.S. Pat. No. 4,801,928, by Minter, hereby incorporated by reference, discloses an egress direction indication system having at least three electroluminescent lamps in a linear arrangement and circuitry for sequentially illuminating the lamps on a repeated basis from one end of the arrangement to the other so as to provide a direction for evacuees in response to a relative danger,such as a fire. However, Minter, does not provide a solution for such notification on a wholesale, building-level approach that can be used to reflect the danger to occupants on other floors/areas from a fire on a different floor/area. Moreover, Minter does not allow for a system that can provide real-time, large-scale intelligence to firemen and other responders to the scene of an alarm. As seen in many recent fires, the fact that fires and/or explosions may have destroyed entire sectors in a building, imparting that particularized geographical knowledge and associated condition data to both evacuees and firemen is vital for maximizing the effectiveness of individual escape efforts, as well as for immediate, intelligent planning of fire fighting and/or rescue operations.

Accordingly, none of the other systems in the prior art provide a solution to indicate the safest exit in a universally understandable, intuitive manner such that all evacuees, anywhere in a building, can immediately grasp the correct direction towards an exit relative to a fire (or fires), wherever it (and they) may be located. In addition, none of the prior art offers intelligent output from such a system, so that firemen and responders can accurately understand the scope of the emergency at hand.

SUMMARY OF THE INVENTION

It is an object of the present invention to provide an easily-understandable, highly visible directional lighting system for evacuation within a fire alarm system that does not consume excessive power and which will reliably and effectively produce sufficient light after an initial period of operation.

It is also an object of the present invention to provide a system that provides information about primary and alternative routes of egress to evacuees on a building-wide level so that all building occupants may evacuate with respect to the relative position of a fire located on any floor or in area of a building.

It is still a further object of the present invention to provide a system that provides information to firemen and rescuers in such a fashion so as to foster a more comprehensive, overall picture of the location and the magnitude(s) of a fire or fires present in a building.

Additional objects, advantages and other novel features of the invention will be set forth in part in the description that follows and in part will become apparent to those skilled in the art upon examination of the following or may be learned with the practice of the invention.

To achieve the foregoing and other objects, and in accordance with one aspect of the present invention as broadly described, a directional lighting system for evacuation as part of a broader intelligent fire alarm system is provided through the situation of a substantially linear arrangement of lighting modules along the lengths of corridors and rooms toward exits. It is preferable for the evacuation direction indication system to have arrow shaped lamps in a linear arrangement on a repeated basis throughout a building such that the lamps can be activated so as to show the nearest, safest exit in relation to the fire or fires registered throughout the system. The lamps will be activated by a local and/or centralized activation module when a given fire alarm is alerted by a fire triggered anywhere throughout a building, thereby providing for a comprehensive, unified direction of exiting set for all areas and floor of a building.

BRIEF DESCRIPTION OF THE DRAWINGS

The accompanying drawings, which are incorporated in and constitute a part of the specification, illustrate a preferred embodiment of the invention and, together with the general description given above and the detailed description of the preferred embodiment given below, serve to explain the principles of the invention.

DETAILED DESCRIPTION OF THE PREFERRED EMBODIMENTS

Reference will now be made in detail to the present preferred embodiment of the invention as illustrated in the accompanying drawings.

Figure 1:
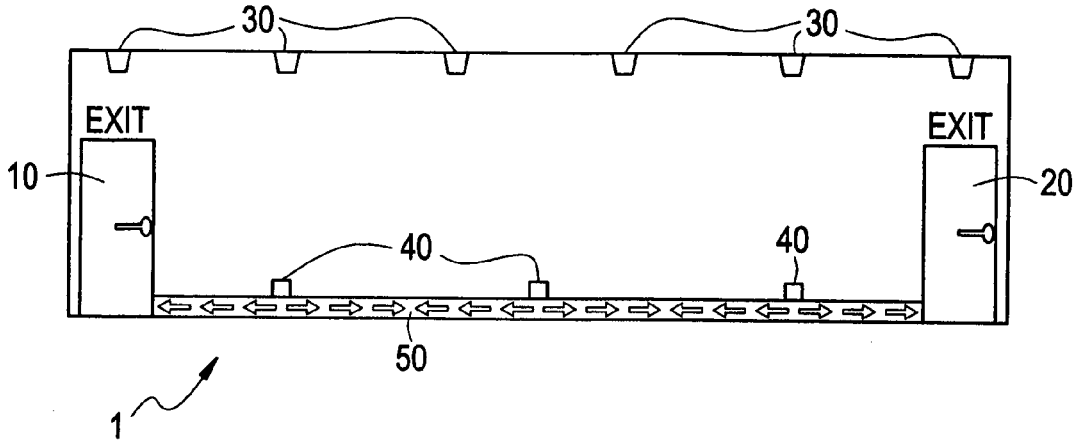
FIG. 1 is a side view of an egress direction indication system incorporating the teachings of the present invention.

In accordance with the present invention there is provided an intelligent directional fire alarm system having an evacuation or exit direction indication system, preferably comprising a multiplicity of fire alarm sensors as threat sensing nodes, a multiplicity of indicator units, and directional lighting modules, said directional lighting modules having at least three electroluminescent lamps in a substantially linear arrangement so that the directional lighting modules may be interconnected from end to end, as needed, in order to track the length of rooms and/or corridors towards an exit or exits. Included within such a unit would be a means for potentially illuminating all electroluminescent lamps on a repeated basis in sequential order, from one end of the linear arrangement to the other end of the linear arrangement as a directional indicator away form the threat identified at the respective location of the threat sensing node(s). FIG. 1 illustrates such an embodiment of the present invention.

Figure 3:
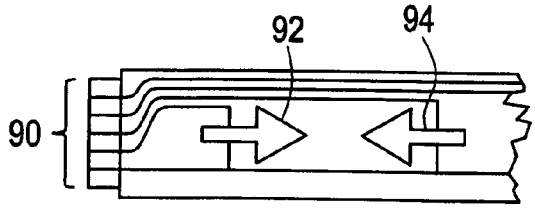
FIG. 3 is a partial detailed view of a linear lamp arrangement portion.
Figure 4:
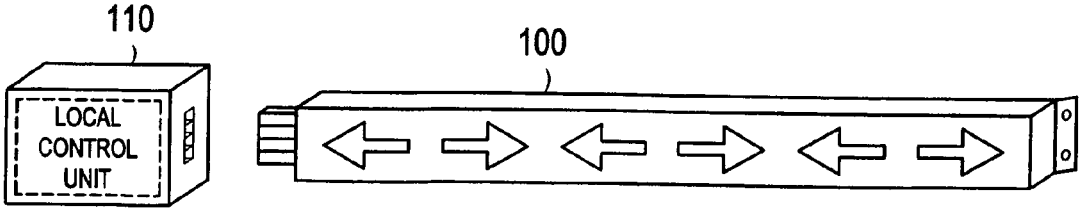
FIG. 4 is an exploded perspective view of a portion of a linear lamp arrangement for the directional exit indication of the present invention.

According to FIG. 1, with ongoing cross reference to FIGS. 3 and 4, intelligent directional fire alarm system 1 includes an indicator units 40, optionally designated in alternative embodiments described hereafter, as local control units 110, are connected via connect interface 90 so that lighting branch 100 can be assembled with the local control units 110 and/or indicators 40 to form a substantially linear arrangement of directional lighting modules 50. Electroluminescent lamps and/or high intensity LEDs are positioned in a linear arrangement and are shaped as arrows 92 and 94 which alternately point from the left ends of the linear arrangement to the right end. Preferably there are six such electroluminescent lamps and/or high intensity LEDs that will comprise a base segment such that, in one example, local control unit 110/indicator 40, combined with lighting branch 100) of a directional indicator unit 50. Depending on individual configuration needs, or depending on the destruction of sectors within a linear arrangement of lamps, indicator units 40 may have a default setting that allows them to become a local control unit 110, effectively transforming an ordinary directional indicator unit 50 that normally acts in a subservient, cooperative fashion with other directional indicator units 40 based on the lead threat signal, as transmitted from threat node(s) 30 and/or a central control box, into a default leader activating the remaining modules that may be still connected to it. The signals may be formatted and generated according to the system described in U.S. Pat. No. 6,141,595, the entirety of which is hereby incorporated by reference.

It is important to note that the threat sensing nodes, while typically configured to sense fires according to temperature, presence of smoke, etc., as known in the art of fire alarms systems, in alternative embodiments, the present invention also provides for alternate sensing functionality for detecting other emergency situations besides fires, such as the presence of carbon monoxide or other poisonous gas (an application which may be particularly useful for detecting emergencies in certain industrial buildings), etc. in lieu of, or in addition to, the fire sensing capabilities. In one particularly advanced embodiment, the threat sensing nodes may further be chosen from the group comprising radiological biological or chemical sensors. Radiological and/or biological based threats may be of particular concern within or near ventilation conduits throughout a given building. Although one may utilize many such sensors known to those skilled in the art of environmental radiological and biological sensing, by way of illustration only, one might utilize sensors and interfacing modules for providing intelligent output for such threat monitoring according to any one, or a combination of the products manufactured by Bruker Daltonics, of Billerica, Mass., BAE Systems/Wind River, of Alameda, Calif., and/or Black Cat Systems of Westminister, Md. Placement of such radiological and/or biological sensors may be limited to one such sensor at a common juncture point throughout the building (preferably in the HVAC intake system), or depending on perceived need or physical size of the building, may be spaced throughout the building or within the grid placement as described herein. Either way, these sensors would operate analogously to the traditional fire-sensing nodes in that they would output an electrical signal into the system when triggered, in addition to any other static signals as programmed. Such sensors, in addition to generating system signals for comprehensive threat detection and evacuation, might also have supplemental functioning, such as the ability to generate a signal that might help in cordoning off "hot" areas of a building, or for simply sending a signal that can be used for shutting down a ventilation or HVAC System so as to prevent any spreading of sensed threats.

In yet another advanced embodiment, the threat sensory nodes may be coupled with standard motion sensors as known in the art of intrusion detection systems, and may be interspersed throughout a building as desired, in order to yield signals from throughout the grid as to where occupants may be moving. Such sensors will similarly output an electrical trigger signal and any necessary static signals that will feed into the overall system (as described analogously herein) for use by firemen and/or rescuers as detailed hereafter.

Figure 2:
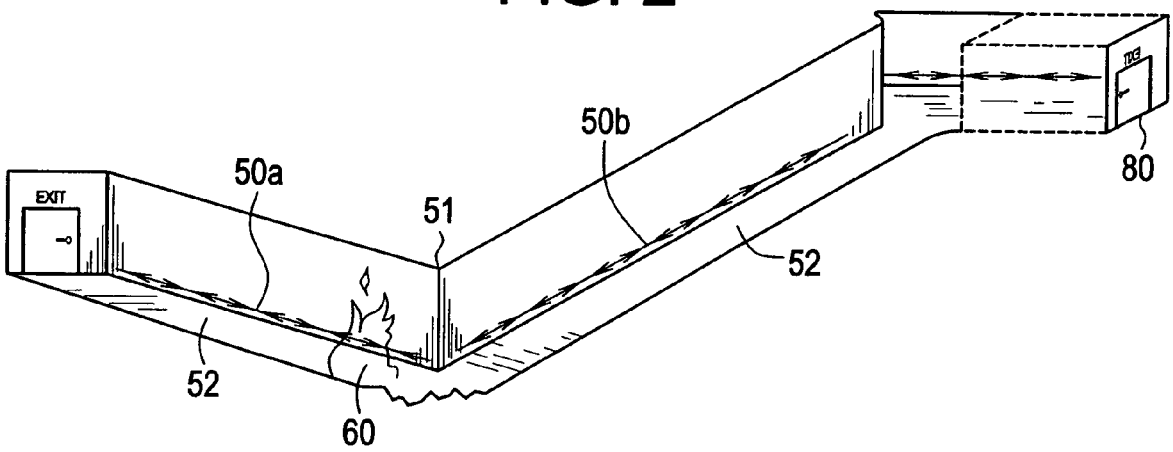
FIG. 2 is an offset, side elevation view of an embodiment of an egress direction indication system incorporating the teachings of the present invention.

Seen in FIG. 2, in an example of one embodiment of the inventive system responding to the particular emergency of a fire threat. Where a fire (not pictured) has been detected say, on the floor directly below the depicted hallway 52 at the corresponding area just below corner 51, directional lighting module 50*a* might point from the edge of corner 51, leftwards in a sequential fashion of directional lamp lighting (preferably high intensity LED lights), towards exit 70, while directional lighting module 50*b* might point from the edge of corner 51, rightwards in a sequential fashion of directional lamp lighting, towards exit 80. However, should the fire from the floor below break through the hallway 52 (now represented as fire 60), then any lighting branches 100 and/or indicators 40 that may be destroyed, will of course, no longer operate, but any of the remaining lighting branches 100, and indicators 40, of the installed directional lighting module 50*a* will still be able to operate based on independent backup power sources (not pictured). When the rightmost intact indicator 40 remaining in the directional lighting module 50*a* receives no lighting signal from the destroyed segment in the sequence, it will take over the lead position on the sequence and will become the local control unit 110 for the other indicators 40 and lighting branch 100 in the remaining sequence towards the exit 70.

Normally, the indicators 40 and/or the local control unit 110 will be operating under direction from either one of two sources: in the case of a fire in the immediate vicinity (such as in the same hallway) a threat signal will be transmitted from the first sensing threat node 30 that happens to be located most proximate to the fire. Typically, standard smoke sensing means as known in the art may trigger a signal such as an infrared signal or hard-wired signal to be received either by the most proximate indicator unit 40 (usually directly below) or ordinarily at a central control box 140 having a microprocessor; or, in the case of the fire being located in a different area, or on a different floor, then the threat signal will be received from a centrally located control box, or alternatively, where entire sectors of connectivity within the system have been compromised because of fire, explosions, or collapse, then backup module report module 116 may offer backup signals for activation of the lights. In an especially preferred embodiment, where the lead node has been completely cut off from all transmission of threat signals, then the remaining indicator 40 that is left intact will, as the default position of local control unit 110, prompt the remaining sectors of the directional lighting module under its connective control to continue flashing according to the last signal received, preferably as stored in small RAM memory provided for within each indicator 40, and as controlled by a standard set of code residing therein for establishing contingency routines based on lack of input signal, as known in the art of simple device programming. Nevertheless, for the sake of simplicity and cost, one preferred embodiment may take advantage of the above detailed configuration by bypassing intermediacy elements of the system, and have the threat node 30 communicate directly with the centrally located microprocessor according to an assigned address. As will be continually referenced throughout, multiple configurations are contemplated for simple routing protocol programming and configuration, as well as simple networking and wireless connectivity and transmissions, all of which may be accomplished as known throughout these arts, but in one preferred embodiment, may be accomplished according to the building network system for devices as set forth in U.S. Pat. No. 6,438,109, the entire document of which is hereby incorporated by reference.

Other forms of lighting (such as manipulation of spaced lasers for providing laser bursts to reflect upon arrow shaped surfaces for providing a directed visual impression of a shape, such as an arrow) are explicitly contemplated for in the present invention. However, lamps such as electroluminescent lamps and/or high intensity LED lights have been found to provide uniform light which is easier to see in smoke-filled conditions, and furthermore, has low power requirements and reliable long life, and is much less expensive to install when compared with lasers. As such, in a preferred embodiment, it is preferable that the high intensity LED lamps are six in number for a given lighting branch 100, and are shaped as arrows, so as to be able to point reversibly from one end of the linear arrangement to the other end of the linear arrangement. Alternatively, the high intensity LED lamps may be non-arrow shapes, such a circles, in order to reduce manufacturing costs, and so as to avoid the need for reversible elements. Such elements would nevertheless still be capable of being sequenced as described herein, in order to provide evacuees with a "runway" type escape route. According to the present invention, the indicator units are most preferably embedded substantially within the floor or wall, with directional arrows each spaced approximately 2 feet from each other, and measure approximately 6 inches in length by 2.5 inches in height, and are located at eye level for persons crawling to egress in smoke filled conditions. Accordingly, in a preferred embodiment, shown in FIGS. 3 and 4 there are two groups of high intensity LED lamps in lighting branch 100, a left group of three electroluminescent lamps (exemplified here by one arrow 94) that point to the left end of the linear arrangement, and a right group of three high intensity LED lamps (exemplified here by one arrow 92) that point to the right end of the linear arrangement. In the arrangement the leftward pointing high intensity LED arrows 94 constitute a first subsystem of indicator unit 40/local control unit 110, and rightward pointing high intensity LED arrows 92 constitute a second subsystem of indicator unit 40/local control unit 110. In accordance with the present invention, the indicator unit includes a plastic extruded panel with the high intensity LED lamps contained within the plastic extrusion. The plastic extruded panel contains a circuit board on which the high intensity LED lamps are mounted and a lens covering the high intensity LED lamps and bonded to the panel. The circuit board on which the lamps are mounted is covered by a phosphorescent/fluorescent material for emitting light that provides illumination after loss of normal lighting during power failure. Indicator unit 40/local control unit 110 includes a planar plastic panel (not depicted) with one side forming the rear surface portion of indicator unit 40/local control unit 110. The preferred panel is extruded plastic in which high intensity LED lamps mounted and contained. The front surface of indicator unit 40/local control unit 110 includes a lens, which is a planar plastic piece capable of passing light from high intensity LED lamps and for protecting the high intensity LED lamps. The lens is preferably bonded to the panel to constitute a single unit. A phosphorescent/fluorescent material is provided on the panel in order to emit light a during power failure. As known in the art, the panel might preferably include a circuit board having printed circuit conductive leads which run along the length of the panel such that each conductor is conducted to a separate high intensity LED lamp. A printed conductor might run along the length of panel and constitutes the ground wire connected to complete the circuit to each high intensity LED lamp. In an especially preferred embodiment, the entire lighting and indication assembly described above may be manufactured of a small enough size (approximately ½ to 3 inches in width, by ½ to 1 inch in depth) so as to fit within a hollowed out center or recessed backing of manufactured decorative molding. Such molding is preferably manufactured by extruding plastic to form stylish molding as common in the art of molding manufacturing, with a continuous hollowed out (longitudinal) center or formed recess running longitudinally along the back (adhesion/installation side) for the entire lighting assembly, and where possible the indicator units to be fitted within the molding so as to afford an elegant installation of the system for buildings where aesthetics are deemed important. In offering such an embodiment, it is contemplated that the extrusion will be formed so as to allow a translucent or transparent covering (approximately ⅛ of an inch thickness) as needed along portions of the outward facing surface of the decorative molding in order that the output from the high intensity LED lamps will not be obscured by the molding body when activated. Forming the system in this manner also has the added benefit of sealing exposed portions of the system off from the potentially damaging effects of fire sprinklers that may activate in the course of a fire. Indicator units may also be situated within the decorative molding, but provision should preferably be made so that the indicator units can receive the signals from the threat sensing nodes, whether via infrared transmission, or through hidden hardwiring. Given the limited space behind decorative molding, any additional elements of the system disclosed herein may be situated behind panels or the like in order to preserve aesthetic appearances of an area as desired.

According to the present invention, the directional lighting module would preferably include a means for sequentially illuminating said at least three high intensity LED lamps on a repeated basis in order from end of the linear arrangement to the other end of the linear arrangement. As known in the art of sequential lighting controls, the illuminating means (not depicted) includes a control unit having a housing and an electronic system. The electronic circuitry might include a sequencer for sequentially illuminating at least three high intensity LED lamps on a repeated basis in order from one end of the linear arrangement of high intensity LED lamps to the other end of the linear arrangement of high intensity LED lamps. As each high intensity LED lamp is sequenced, it may continue to be illuminated or alternatively, may be shut off while the remaining lamps in the linear arrangement are being sequentially illuminated. The set of high intensity LED lamps then cease being illuminated and the sequence repeats. In one preferred embodiment, the illuminating means would then include a sequencer, a high frequency inverter, a battery and a battery charger for illuminating the high intensity LED lamps with an independent power supply. Such a charger might be connected to the power supply for the building (either locally or through central control box 140) and might include a battery that might be connected to sequencer through solid state switch as needed. When provisioned as such, the illuminating means within the directional lighting module can be activated in response to power failure and/or in response to smoke detection as the solid state switch connects to the battery and to the sequencer, for immediate activation when it is no longer supplied with power either because of a power failure or because of a direct threat signal it has received in the normal course of alarm operation.

In terms of the normal course of alarm operation, there is provided for in one embodiment for a means for actuating the illuminating means in response to smoke detection. In this one embodiment, each (or at least an even spaced number of) threat sensing node(s) will have an infrared transmitter (in addition to, or in lieu of a hard-wired connection) that will be tripped when smoke is sensed, transmitting a directed infrared signal to the proximate indicator unit 40/local control unit 110, which is correspondingly equipped with an infrared reception means (not pictured), and a means for actuating itself (not pictured) as known in the art of infrared remote controllers.

In accordance with the present invention, the system might include a housing for containing the above described electronic circuitry, and wherein there is a complementary connecting means (not depicted) on the panel and the housing, including a male electrical connector and a complementary female electrical connector. The male electrical connectors might include contacts connected to electric conductors. Contacts in the male electric connector could then engage the contacts in female electric connector. When the male electric connector is inserted into female electric connector, the left end of panel is supported relative to housing. It is also possible to use flexible electrical conduit and electrical connectors to removably connect the electronics of panel and housing. The connecting means is located in the panel at one of said ends of the linear arrangement. The connecting means is male connector, located at the left end of the linear arrangement and because the panel at the other of said ends of the linear arrangement includes means for fastening, the panel to a wall (preferably low the ground for greater visibility for evacuees who may be crawling to avoid smoke inhalation), or in an especially preferred embodiment, located along the ground floor of the room/corridor, much akin to the "runway lights" as configured in airports.

Figure 5:
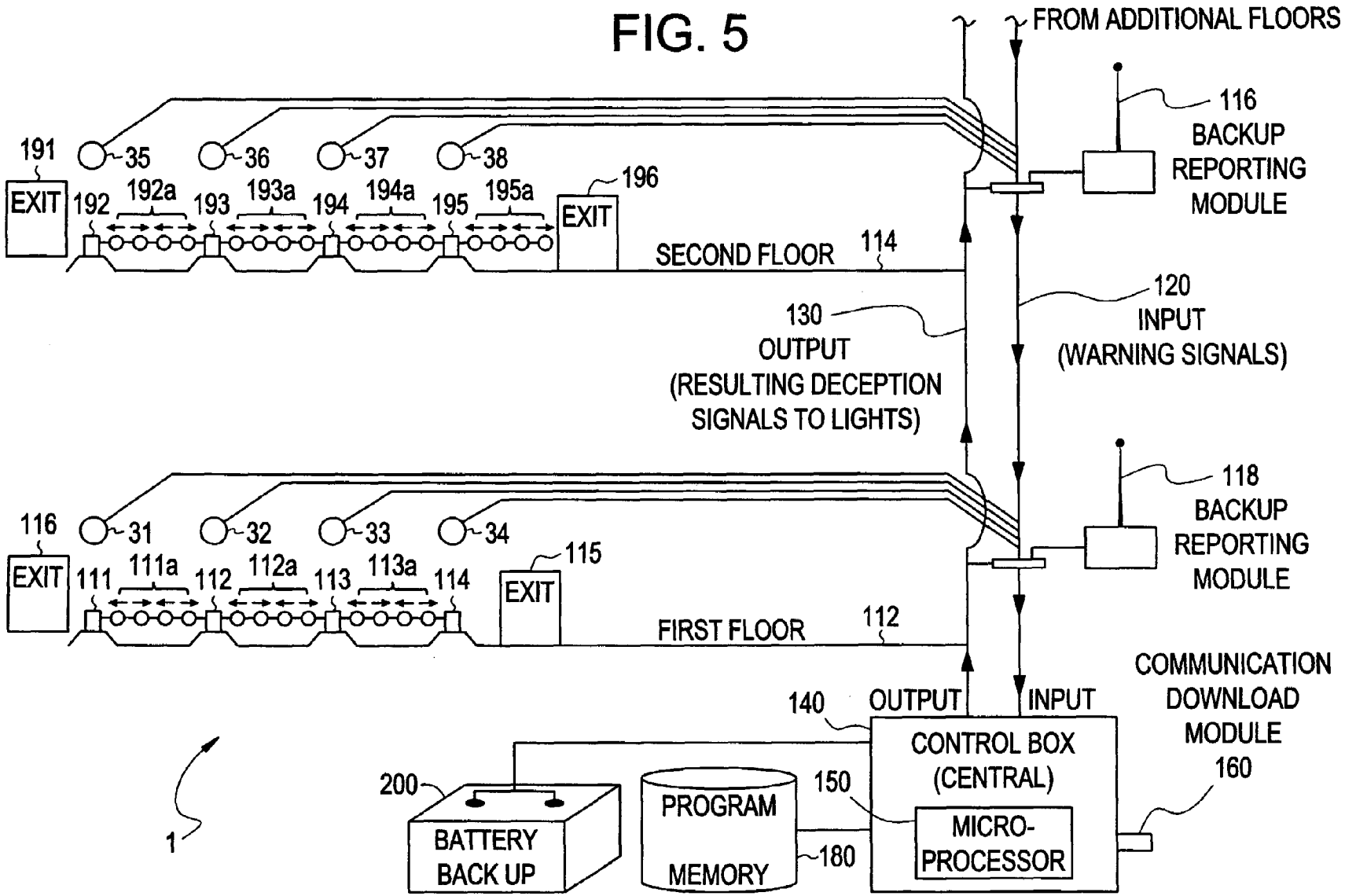
FIG. 5 is a block diagram of the electronic system aspect of the invention for providing intelligent feedback and for interconnectively illuminating lamps in the indication system throughout different areas and on different floors inside a building.

According to the present invention, there is provided a directional emergency alarm comprising a plurality of indicator units, each indicator unit connected to at least three high intensity LED lamps in a linear arrangement; and means for sequentially illuminating said at least three high intensity LED lamps on a repeated basis in order from one end of the linear arrangement to the other end of the linear arrangement; each linear arrangement is mounted on either a wall or floor and is spaced from adjacent indicator units; a first indicator unit is positioned near a point of egress and oriented so that the linear arrangement of its lamps are sequentially illuminated in the direction of the point of egress; and at least one other indicator unit is oriented so that the linear arrangement of its lamps are sequentially illuminated in the direction of the first indicator unit. As shown in FIG. 5, in a preferred embodiment, there are a multiplicity of indicator units such as described above, and as illustrated on the second floor level 114, where each indicator unit 192, 193, 194, 195 is mounted next to, or on, the corridor/room wall (not shown), spaced from adjacent indicator units, and situated in communication with all of the area indicator units, so as to control its own respective directional lighting module lighting branch (192*a*, 193*a*, 194*a*, 195*a*). As part of the entire sequencing process described above, it is contemplated that one indicator unit 40 can act as the local control unit 110 for leading the directional lighting relative to the fire indication as communicated directly by the proximate threat sensing node (either 35, 36, 37 or 38, if the fire is detected in this area/this floor), or indirectly from the central control box 140 via common output line 130, as part of its output report formulated by microprocessor 150, based on corresponding threat sensor node outputs on other floors/areas that have communicated a fire and its relative location to central control box 140 via common input line 120. As shown in FIG. 5, the indicator units and the corresponding lighting branches are oriented so that the linear arrangement of its lamps are sequentially illuminated in the direction of the available exits. In another preferred embodiment, and as depicted on the first floor 112 of the exemplary building in FIG. 5, at least one other indicator unit 114 may be installed so that it is not necessarily paired with a specific lighting branch, but instead acts as the designated lead for the entire linear arrangement thereto (e.g., indicator unit 111 is paired with lighting branch 111*a*; indicator unit 112 is paired with lighting branch 112*a*; and indicator unit 113 is paired with lighting branch 113*a*).

Figure 7:
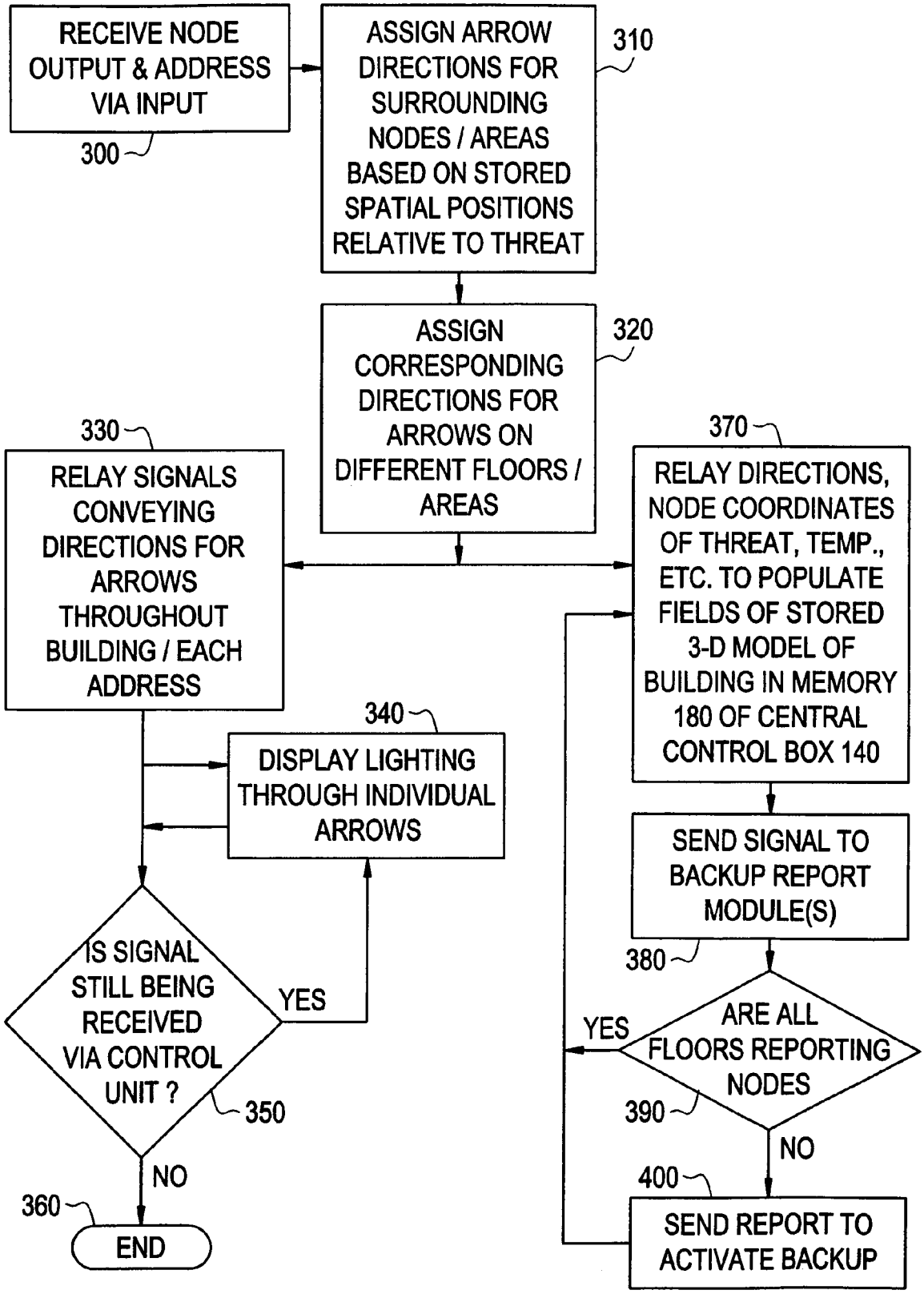
FIG. 7 is a flow diagram of the input and output of signals and notifications by the reporting nodes and the processing module of the electronic system shown in FIG. 5.

When provisioned as such, and with general reference to the exemplary signal processing methodology indicated in the flow diagram in FIG. 7, a cooperative, interconnected system is structured so as to form the basis for an intelligent fire alarm system. In one specific preferred embodiment, the lead indicator will be determined by the relative threat, as identified in either by the proximate threat sensing node, or by the central control box 140, which has, in its programmable memory 180, a look up table that has been configured as known in the art, for assigning each threat sensing node throughout the building a grid address. As known in the art of assigning unique signal addresses that can indicate an origin of transmission, each threat sensing node has a unique identifier that is preferably an alphanumeric address assigned to it during installation according to an orderly grid assignment based on the target building layout so that it can communicate directly, or indirectly with the main processor in the system. All grid addresses are correlated to each other in the overall grid stored in the programmable memory at 180. By way of example, if say, sensing node 33 activates because there is a fire located closest to that particular node, then the unique identifier signal (preferably generated by a common, low power ship set provided within that can accommodate or generate a packet containing all such information to be transmitted, as known in the art of packet based communication in computer networking) that this threat sensing node sends to the central control box 140 along common input line 120 (along with any optional information that can be identified by the node, such as ambient temperature at smoke filled area, etc.), is processed by the microprocessor 150, so that the output from the central control box 140, transmitted along common output line 130, will send out signals to all indicator units in the building (each of whose circuitry or chip sets would be provided and configured as known in the art of networking) that they should signal in straight lines toward all available exits. Where there are more than two exits in a given hallway/room, then the building layout devised during installation will recognize that, all other things being equal, a given floor or room should be divided at the spatial middle as determined by the installers who physically assess the spatial dimensions before configuring the building spaces and the building parameters to be configured in the memory of the system, so that even person encountering the signal at the very middle of a given room/hallway could take either equidistant route to one of several exits that might be available. However, because conditions in a fire are not readily isolatable, the exception to this described methodology is that in the above example, all floors/areas except the second floor area 114 located in immediate proximity to the identified threat at 33 on first floor 112, would be activated by such a signal to the area indicator units. In the case of the second floor, the microprocessor would have identified, through the correlation in the lookup table of addresses, that threat sensing node 33 is directly below threat sensing node 37 on second floor 114. Given that fires can expand in many different directions rapidly, separate nodal areas on the grid that are three dimensionally contiguous, with the threatened area are therefore presumed susceptible to impending danger even if the threat sensing node 37 has not yet been activated. Accordingly, where threat sensing node 33 has been activated, an infrared signal will be transmitted to the immediately proximate indicator unit(s) (in this case, 113), which will signal lighting branch 113 a to signal away from the immediate are represented at or near threat sensing node 33, towards the left in the direction of exit 115. Simultaneously, indicator unit 113 will signal lighting branch 112*a* to signal in the left hand direction, at which point the signal will be received at indicator unit 112, which will in turn signal lighting branch 111*a* to signal in the same direction leftwards toward exit 111, so that evacuees would be able to follow from the indicator through to the exit, without any concerns about having to cross through a threatened area to reach an exit. At the same time, threat sensing node 33 will transmit an alarm signal, that will indicate the address of the threat sensing node, and any accompanying information such as temperature, etc, to the central control box 140 as described, and the additional contiguous areas, such as the area directly above (or alternatively, directly next to the area on the same floor (not depicted). This means, that in this example, the signal will be sent to activate the applicable indicator unit on the second floor 114, in this case, indicator unit 194 (which will then assume its primacy among the other indicator units as the now-designated local control box) in order to direct lighting branch 194*a* to signal rightwards, along with lighting branch 195*a*, when activated sequentially via indicator unit 195 form the signal received through lighting branch 194*a*, rightwards toward exit 196. Similarly, lighting branches 192*a* and 193 would, with the cooperation of the respectively paired indicating units 192 and 193, be illuminating the arrows pointing leftwards toward exit 191 in a sequential, pulsed fashion.

In case where the interconnectivity of the system has been compromised, such as in cases where the power has been cut somewhere in the system and/or where the cooperative signaling has broken down as determined through a polling procedure known in the art of computer networking, a switch like those known in the art of backup systems can be opened to actuate a local battery backup as provided for on a given floor or area, and in an especially preferred embodiment, a plurality of backup report modules may also be provided for so as to continue to provide an intelligent report of conditions as described below, to rescuers and firemen.

Figure 6:
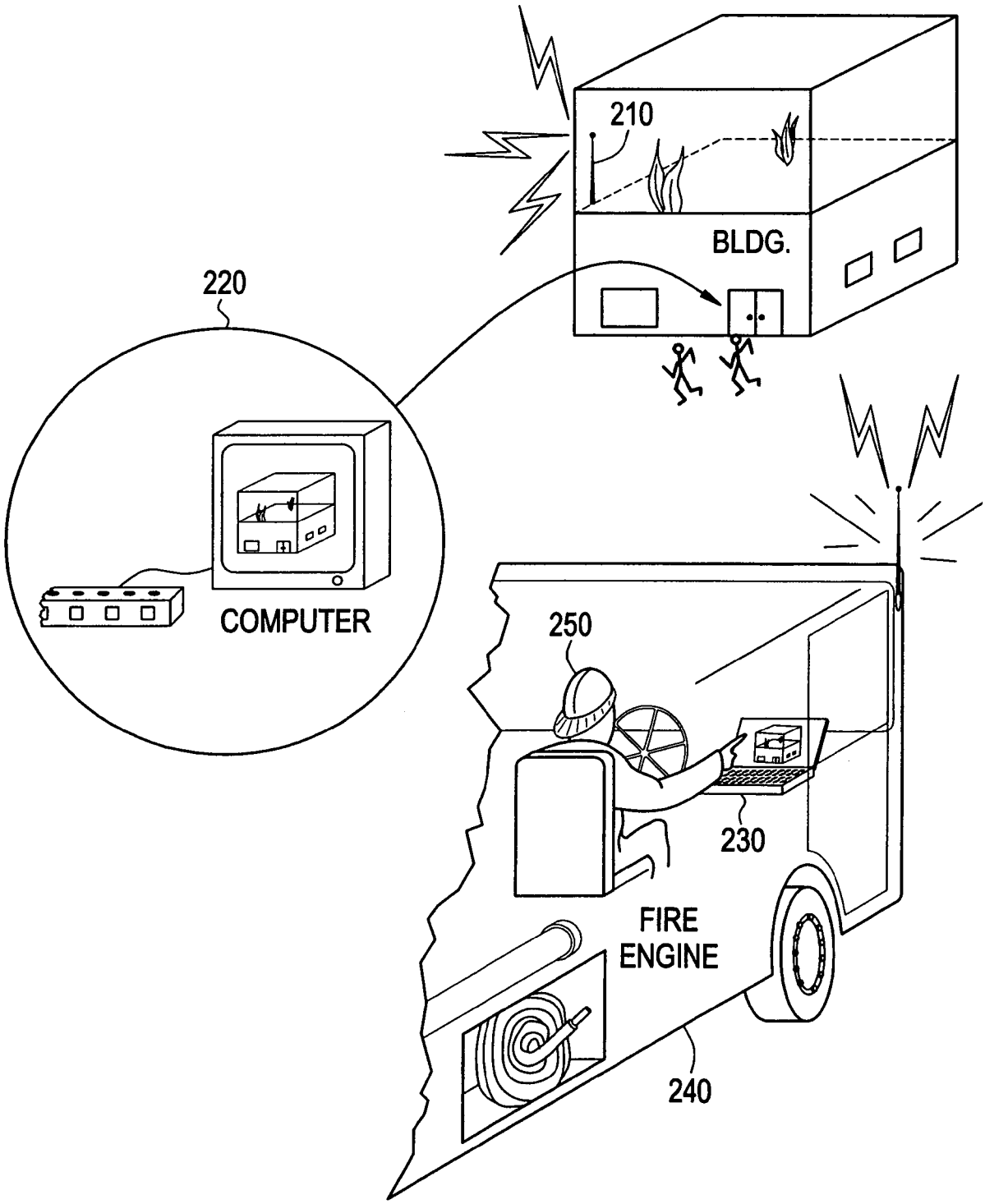
FIG. 6 is an elevation perspective of an exemplary usage of the intelligent feedback from the present system, both at the hard wired level through a ground level monitor displaying real time 3-D images of the fire progression, and wirelessly through mobile interfacing modules that can display the same real time 3-D images for responding authorities.

Whether provided for in standard operations through the central control box 140, or whether provided for in cases where either common input line 120, common output line 130, and/or the general system power conveyed along these lines has been disrupted due to fire, explosion, or some structural collapse, provided by a backup report module, the system will be able to continue to generate intelligent reports about the all remaining threat sensing nodes that are actively reporting within their area as to fire location, temperature, etc. To this end, each backup report module, with the exception of the provision of the wireless transmission means, is preferably structured as a lower power version of the more robust central control box. The sum of all this data is transmitted—whether from the central control box 140 in say a lobby, or through wireless e.g. radio frequency or cell type as known in the art of cell transmission technologies and the like—to an emergency responder receptor as depicted in FIG. 6. The output can be displayed on a resident monitor (inset 220) on site, or to a common interface on say, a rescuers lap top computer 250. The representation will ideally be in the form of a useful representation such as a 3-D transparent representation of a building and it floors/areas such as depicted according to the system in U.S. Pat. No. 6,701,281, the entirety of which is hereby incorporated by reference. The data transmitted in the intelligent report will have this representation sent as part of the format, with the 3-D layout information resident in either the local backup memory (not depicted) of the back up report modules, and/or as stored in the central control box. In the case of say, discontinuity of the system connectivity, the corresponding data from all local threat sensing nodes are aggregated on an area-by-area level at the collection of the locally paired-up back up report modules, and transmitted wirelessly to an emergency responder receptor and possibly to other report generators in order to re-establish intelligent coordination amongst the remaining directional lighting modules as possible. The exact configuration of the packets of information transmitted may be collected and formatted for according to the various methods known in the art of wireless media technologies, and then configured as a 3-D representation as known in the art of 3-D screen modeling. Representation in this manner offers firemen and rescuers a superior understanding of the threat representations within a building. This is deemed particularly important because in the case of large edifices, or where voluminous smoke has shrouded visual confirmation of different interior fires, the 3-D visual of all threats within a building can help responders to more intelligently asses risks and to better direct rescue and firefighting efforts.

It will be both appreciated and understood by a person of ordinary skill in the art that the amount of lighting modules installed, and the backup units, and interconnectivity between all of the elements of the system can be chosen according to a specific need, dependent upon expense, building layout, etc. It is to be understood that the invention is not limited to the illustrations described and shown herein, which are deemed to be more illustrative of the best modes of carrying out the invention, and which are susceptible of modification of form, size, arrangement of parts and details operation. These modifications are within the spirit and scope of the appended claims.

What is claimed is:

1. An intelligent directional emergency alarm system for a building having at least first and second areas to be protected, said alarm system comprising:

(a) a plurality of threat sensing nodes, at least one threat sensing node located in each of at least first and second areas of a building, each of said plurality of threat sensing nodes responsive to detection of a threat, for generating a warning signal representing said threat, said warning signal including an indication of which threat sensing node is generating said warning signal;

(b) a plurality of directional lighting modules, each directional lighting module having a plurality of light sources in a linear arrangement, said linear arrangement having a first end and a second end, and configured for receiving a directional lighting module activation signal for causing said plurality of light sources to illuminate in a predetermined arrangement;

(c) at least one microprocessor based control module, coupled to said plurality of threat sensing nodes, and configured for receiving said warning signal and for generating a control module report signal in response to said warning signals, wherein said control module report signal is based on said received warning signals from all threat sensing nodes in all areas of said building, and wherein in preparing said control module report signal, said microprocessor based control module is configured for accessing previously stored information including a physical location of each threat sensing node, physical location of each exit in a building and physical relationship of each threat sensing node vis-à-vis each building exit; and (d) a plurality of indicator units, each of said plurality of indicator units coupled to one or more directional lighting modules, each indicator unit responsive to said control module report signal, and configured for selectively activating each of said plurality of connected directional lighting modules based on reception of said warning signal and said control module report signal, so as to indicate a specific direction away from the threat through a sequential illumination of each of said plurality of light sources in order from said first end of the linear arrangement to said second end of the linear arrangement or from said second end of the linear arrangement to said first end of the linear arrangement to ensure evacuees are moving away from all threats in all areas of said building using one or more predetermined exits as determined by said microprocessor based control module.

2. The system of claim 1 wherein the light sources are high intensity LED lamps and capable of pointing from said first end of the linear arrangement to said second end of the linear arrangement, and vice-versa.

3. The system of claim 2 wherein the high intensity LED lamps associated with each indicator unit are positioned near each other and constitute an assembly in which the direction of their sequential pattern is readily observable.

4. The system of claim 3 wherein the indicator unit includes a sequencer, a high frequency inverter, a battery and a battery charger for illuminating the high intensity LED lamps with an independent power supply.

5. The system of claim 3 wherein the assembly described is positioned on a wall within decorative molding.

6. The system of claim 5 wherein the assembly described is positioned within decorative molding situated at the corner of a floor of an area and the contiguous wall of the area in a substantially linear fashion so as to be readily visible to evacuees crawling to an escape in smoke filled conditions.

7. The system of claim 1 wherein the control module for receiving said warning signal and for generating said control module report signal is a centralized control module that upon receiving said warning signal, can process said warning signal so as to generate at least one report having a visual representation so as assist responders to said threat.

8. The system of claim 1 further including a backup and report module for actuating each directional lighting module in response to a system interconnectivity failure.

9. The system of claim 1 further including a backup and report module for generating said microprocessor based control module report signal in response to a system interconnectivity failure.

10. The system of claim 9 wherein the backup and report module for generating said control module report signal in response to a system interconnectivity failure includes a wireless transmission means for communicating said report.

11. The system of claim 9 wherein the at least one threat sensing node is chosen from the group comprising fire, radiological, biological, or chemical sensors.

* * * * *